US011236615B1

(12) United States Patent
Burton et al.

(10) Patent No.: US 11,236,615 B1
(45) Date of Patent: Feb. 1, 2022

(54) STATOR ASSEMBLY FOR COMPRESSOR MID-PLANE ROTOR BALANCING AND SEALING IN GAS TURBINE ENGINE

(71) Applicant: Solar Turbines Incorporated, San Diego, CA (US)

(72) Inventors: David A. Burton, San Diego, CA (US); Kwok-Kwong Ben Tse, San Diego, CA (US); David Lau, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 17/009,469

(22) Filed: Sep. 1, 2020

(51) Int. Cl.

| | |
|---|---|
| ***F01D 9/04*** | (2006.01) |
| ***F01D 5/02*** | (2006.01) |
| ***F01D 9/06*** | (2006.01) |
| ***F01D 17/16*** | (2006.01) |
| *F01D 25/24* | (2006.01) |

(52) U.S. Cl.
CPC ..... *F01D 5/027* (2013.01); *F01D 9/042* (2013.01); *F01D 9/06* (2013.01); *F01D 17/162* (2013.01); *F01D 25/246* (2013.01)

(58) Field of Classification Search
CPC ... F01D 9/042; F01D 9/04; F01D 9/06; F01D 5/027; F01D 17/162; F01D 25/246
See application file for complete search history.

(56) References Cited

U.S. PATENT DOCUMENTS 2,972,441 A 2/1961 Hall
3,362,160 A * 1/1968 Bourgeios ..... F01D 21/003 60/805
3,778,184 A * 12/1973 Wood ..... F01D 25/04 415/209.4

(Continued)

FOREIGN PATENT DOCUMENTS

DE 102005025085 A1 11/2006
EP 0513958 A2 11/1992

(Continued)

OTHER PUBLICATIONS

Written Opinion and European Search Report for Int'l Patent Appln. No. 21190235.8-1004, dated Aug. 11, 2021 (9 pgs).

*Primary Examiner* — Woody A Lee, Jr.
*Assistant Examiner* — Behnoush Haghighian
(74) *Attorney, Agent, or Firm* — Procopio, Cory, Hargreaves & Savitch LLP; Jeff A. Greene

(57) ABSTRACT

A stator assembly, at a compressor mid-plane in a gas turbine engine, to be mounted around a rotor disc, enables access to the rotor disc (e.g., for trim balancing), without requiring disassembly of the stator assembly and/or a compressor case in which the stator assembly is housed, via a removable stator vane. The stator assembly may comprise vane apertures, aligned along a radial axis, that hold the removable stator vane when inserted into the stator assembly, and provide a radial pathway to the rotor disc, when the removable stator vane is removed from the stator assembly. In addition, a case access assembly may seal the removable (Continued)

stator vane in place within a compressor case when engaged, and provide access to the removable stator vane and radial pathway through the compressor case when disengaged. This enables trim balancing of a mid-plane compressor rotor assembly through the stator assembly and compressor case.

18 Claims, 12 Drawing Sheets

(56) References Cited

U.S. PATENT DOCUMENTS 3,985,465 A 10/1976 Sheldon
4,169,692 A * 10/1979 McDonough ..... F01D 9/041 415/115
4,245,954 A * 1/1981 Glenn ..... F01D 5/284 415/200
4,395,195 A * 7/1983 De Cosmo ..... F01D 11/001 415/137
5,226,789 A * 7/1993 Donges ..... F04D 29/542 415/189
6,884,030 B2 * 4/2005 Darkins, Jr. ..... F01D 9/042 29/889.22
7,713,022 B2 * 5/2010 Major ..... F01D 17/162 415/160
7,806,652 B2 * 10/2010 Major ..... F04D 29/563 415/160
7,874,791 B2 1/2011 Ferber et al.
8,087,881 B1 * 1/2012 Cardoso, III ..... F01D 5/26 415/119
8,157,507 B1 * 4/2012 Coffin ..... F01D 5/26 415/119
8,256,088 B2 * 9/2012 James ..... F01D 9/044 29/447
8,371,812 B2 * 2/2013 Manteiga ..... F01D 25/28 415/209.3
8,500,394 B2 * 8/2013 Major ..... F01D 17/162 415/160
8,668,445 B2 * 3/2014 Crespo ..... F01D 17/162 415/160
9,127,555 B2 * 9/2015 Muscat ..... F01D 9/042
9,982,547 B2 * 5/2018 Boeck ..... F04D 29/644
10,280,941 B2 * 5/2019 Mouton ..... F04D 29/644
10,450,877 B2 * 10/2019 Boeck ..... F01D 9/02
10,655,482 B2 * 5/2020 Freeman ..... F01D 9/044
2008/0219832 A1 * 9/2008 Major ..... F01D 17/162 415/65
2008/0298970 A1 12/2008 Ferber et al.
2010/0132374 A1 * 6/2010 Manteiga ..... F01D 9/02 60/796
2011/0286851 A1 * 11/2011 Benkler ..... F01D 9/042 416/223 R
2012/0093632 A1 * 4/2012 Crespo ..... F01D 9/04 415/151
2012/0151937 A1 * 6/2012 Muscat ..... F01D 5/027 60/805
2015/0377042 A1 * 12/2015 Boeck ..... F04D 29/563 415/208.1
2015/0377061 A1 * 12/2015 Boeck ..... F01D 17/162 415/160
2016/0230576 A1 * 8/2016 Freeman ..... F01D 9/041
2021/0108525 A1 * 4/2021 Jarrossay ..... F01D 9/041
2021/0172330 A1 * 6/2021 Quennehen ..... F01D 25/246

FOREIGN PATENT DOCUMENTS

FR 3080146 B1 4/2021
GB 776847 A 6/1957
JP 2001200707 A 7/2001

* cited by examiner

100

100

STATOR ASSEMBLY FOR COMPRESSOR MID-PLANE ROTOR BALANCING AND SEALING IN GAS TURBINE ENGINE

TECHNICAL FIELD

The embodiments described herein are generally directed to a stator assembly, and, more particularly, to a stator assembly that enables compressor rotor assembly trim balancing in situ and gas path flow sealing at the compressor mid-plane in a gas turbine engine.

BACKGROUND

In gas turbines, from time to time, high vibration levels occur due to rotor unbalance, rotor fouling (e.g., dirt or other deposits on the rotor), defects in blades and seal materials due to rubbing, and foreign object damage (FOD). Conventionally, trim balancing of a compressor mid-plane rotor assembly requires at least partial disassembly (e.g., splitting) of the compressor case and removal of compressor blades to reach the balance location underneath the blade platform. Thus, the time, energy, and risk required to trim balance the mid-plane rotor assembly is high.

For example, U.S. Patent Pub. No. 2008/0298970 discloses a shroud ring on outer radial ends of rotating blades. U.S. Pat. No. 2,972,441 discloses adjustable stator blades with an inner and outer shroud. However, neither of these references provide a means for balancing and sealing a compressor mid-plane rotor assembly without requiring a split of the compressor case. The present disclosure is directed toward overcoming one or more of the problems discovered by the inventors.

SUMMARY

In an embodiment, a stator assembly is disclosed that comprises: a seal ring comprising a seal ring aperture extending therethrough along a radial axis, wherein the seal ring is configured to mount around a mid-plane trim balance rotor disc, and wherein the seal ring aperture is configured to, when the seal ring is mounted around the mid-plane trim balance rotor disc, provide access to the mid-plane trim balance rotor disc along the radial axis.

In an embodiment, a stator assembly is disclosed that comprises: an inner diameter ring assembly that comprises a first vane aperture and a seal ring aperture aligned along a radial axis; an outer diameter ring assembly that is concentric with the inner diameter ring assembly and has a larger diameter than the inner diameter ring assembly, wherein the outer diameter ring assembly comprises a second vane aperture that is aligned with the seal ring aperture and the first vane aperture along the radial axis; a plurality of fixed stator vanes that each comprise an airfoil extending between the inner diameter ring assembly and the outer diameter ring assembly; and a removable stator vane comprising a button configured to be seated within the first vane aperture, a platform configured to be seated within the second vane aperture, and an airfoil between the button and the platform, wherein, while the button is seated within the first vane aperture and the platform is seated within the second vane aperture, the airfoil extends between the inner diameter ring assembly and the outer diameter ring assembly along the radial axis, and wherein the removable stator vane is configured to be removed by being pulled radially outward along the radial axis.

BRIEF DESCRIPTION OF THE DRAWINGS

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments, and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description.

Figure 1:
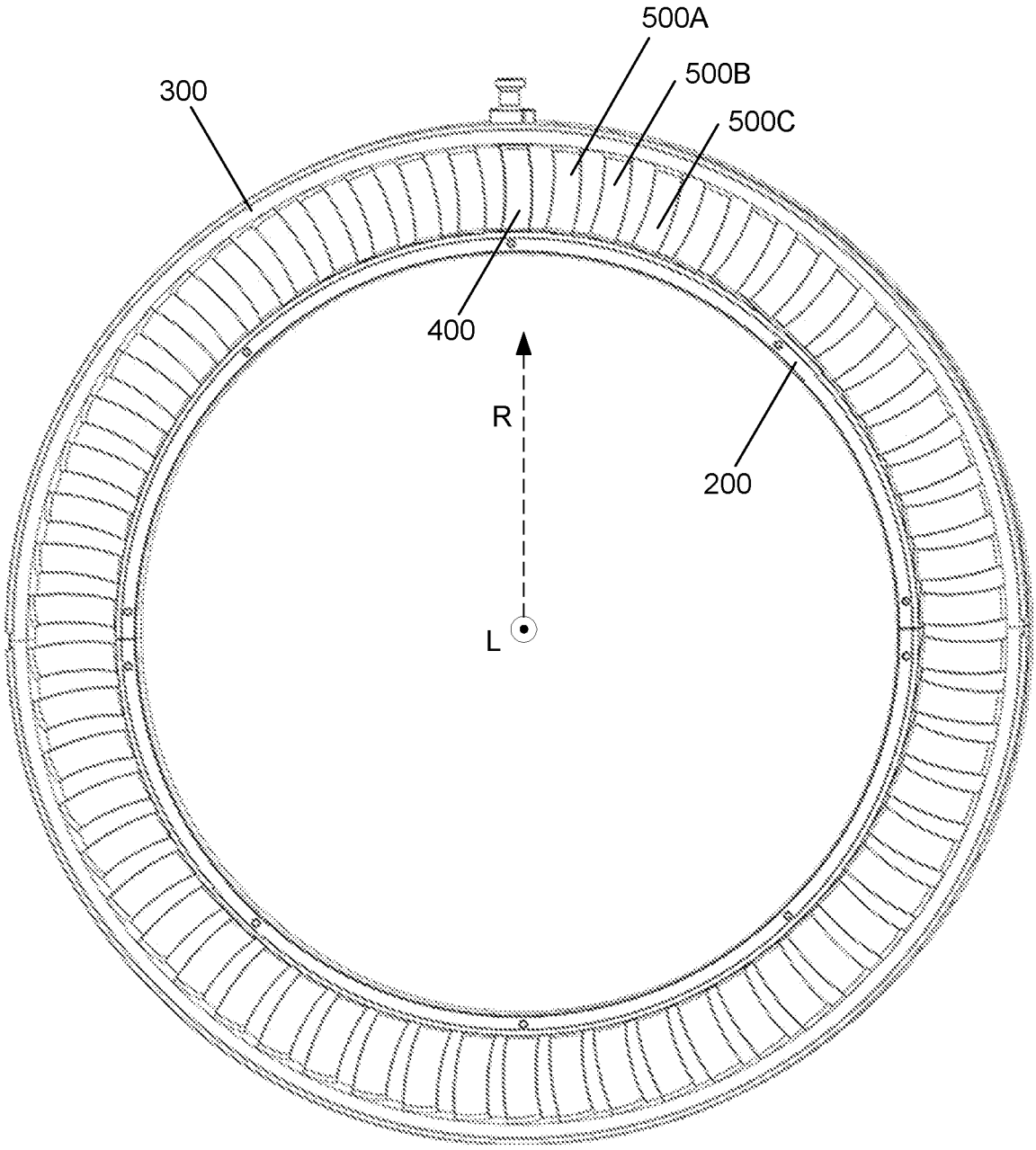
FIG. 1 illustrates a view along the longitudinal axis of a stator assembly, according to an embodiment.
Figure 2:
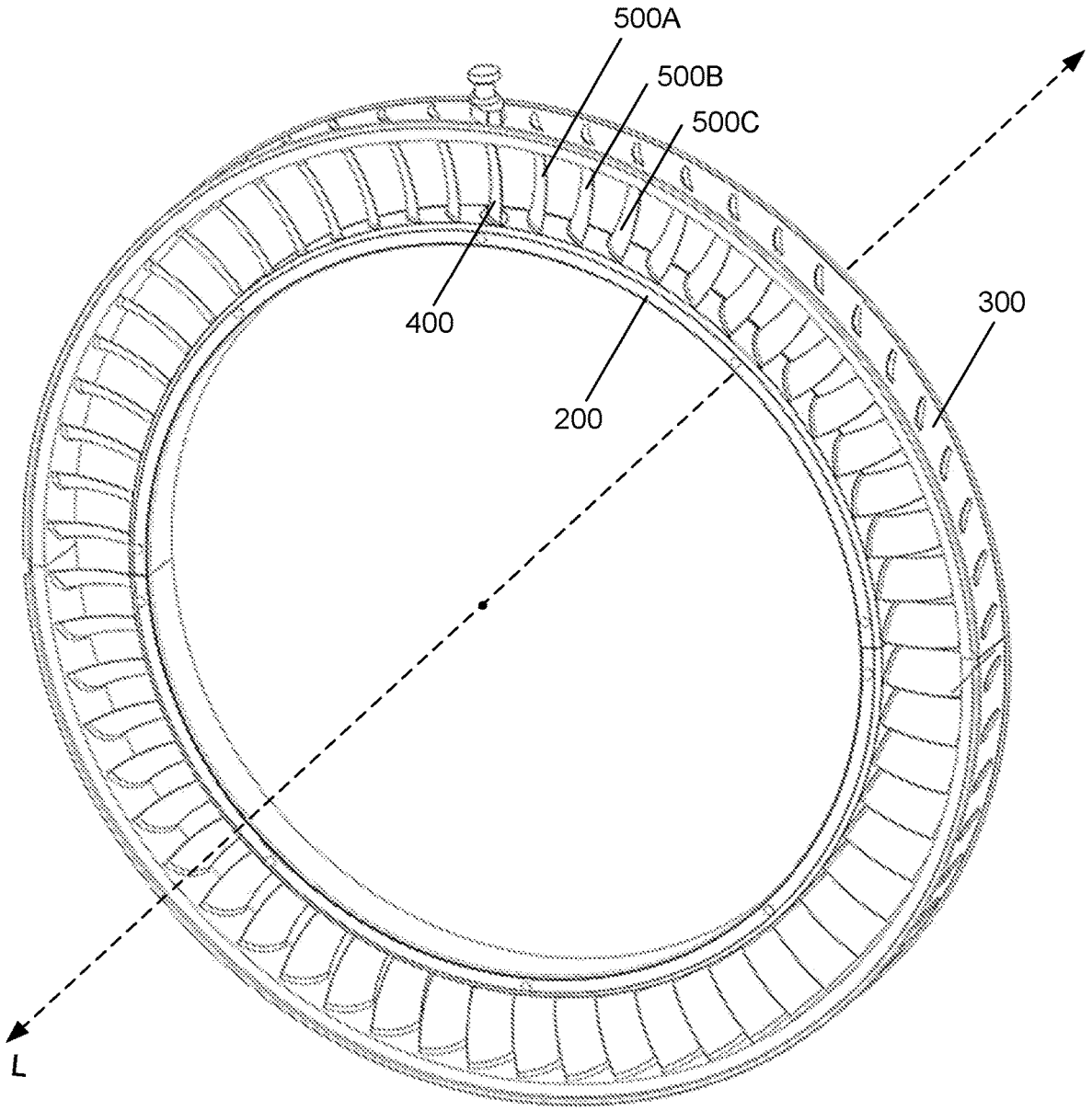
FIG. 2 illustrates a perspective view of a stator assembly, according to an embodiment.

FIG. 1 illustrates a view along the longitudinal axis L of a stator assembly 100, and FIG. 2 illustrates a perspective view of stator assembly 100, according to an embodiment. FIG. 1 also establishes the central radial axis R for a removable stator vane 400 described herein. As illustrated, stator assembly 100 is substantially circular in the view along longitudinal axis L. Stator assembly 100 comprises an inner diameter ring assembly 200 and an outer diameter ring assembly 300, which is concentric with inner diameter ring assembly 200 and has an inner radius that is greater than the outer radius of inner diameter ring assembly 200 to thereby encircle inner diameter ring assembly 200. Inner diameter ring assembly 200 and outer diameter ring assembly 300 may each comprise a plurality of segments. For example, each of inner diameter ring assembly 200 and outer diameter ring assembly 300 may comprise two semicircular segments that are joined to form the respective assembly. Alternatively, inner diameter ring assembly 200 and/or outer diameter ring assembly 300 could consist of a single segment or could comprise three or more segments.

Stator assembly 100 also comprises at least one removable stator vane 400 and a plurality of fixed stator vanes 500 (e.g., including fixed stator vanes 500A, 500B, and 500C as representative). Removable stator vane 400 and fixed stator vanes 500 each comprise an airfoil that extends radially between the inner diameter ring assembly 200 and the outer diameter ring assembly 300. As illustrated, the center of removable stator vane 400 extends along a radial axis R. In an embodiment, stator assembly 100 consists of only a single removable stator vane 400. Collectively, removable stator vane 400 and fixed stator vanes 500 are equidistantly spaced around the entire perimeter of stator assembly 100.

Figure 3:
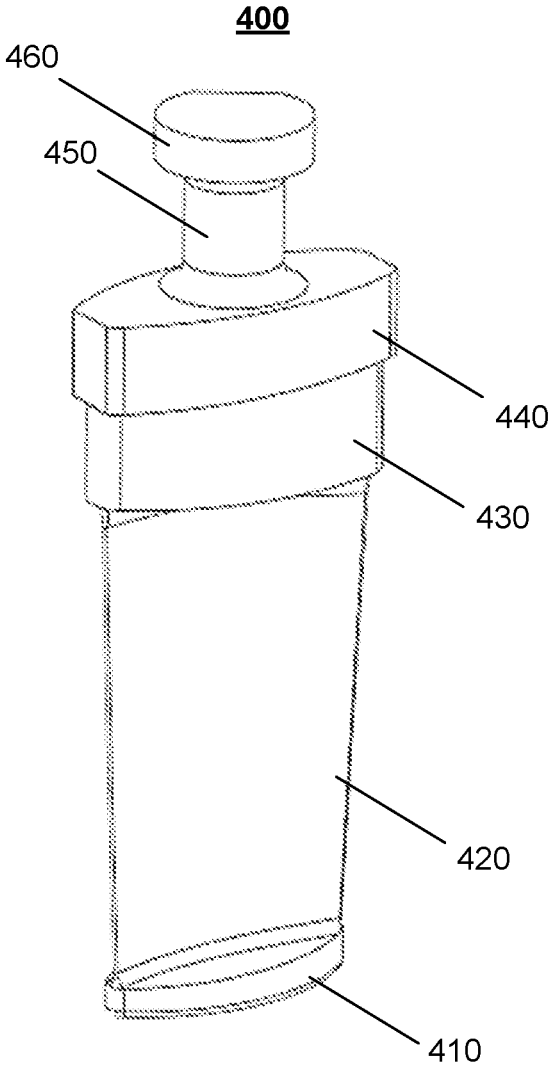
FIG. 3 illustrates a perspective view of a removable stator vane, according to an embodiment.

FIG. 3 illustrates a perspective view of removable stator vane 400, according to an embodiment. Removable stator vane 400 may comprise a button 410, airfoil 420, platform 430, stop 440, stem 450, and knob 460. Each of these components of removable stator vane 400 will be described in greater detail below.

Figure 4:
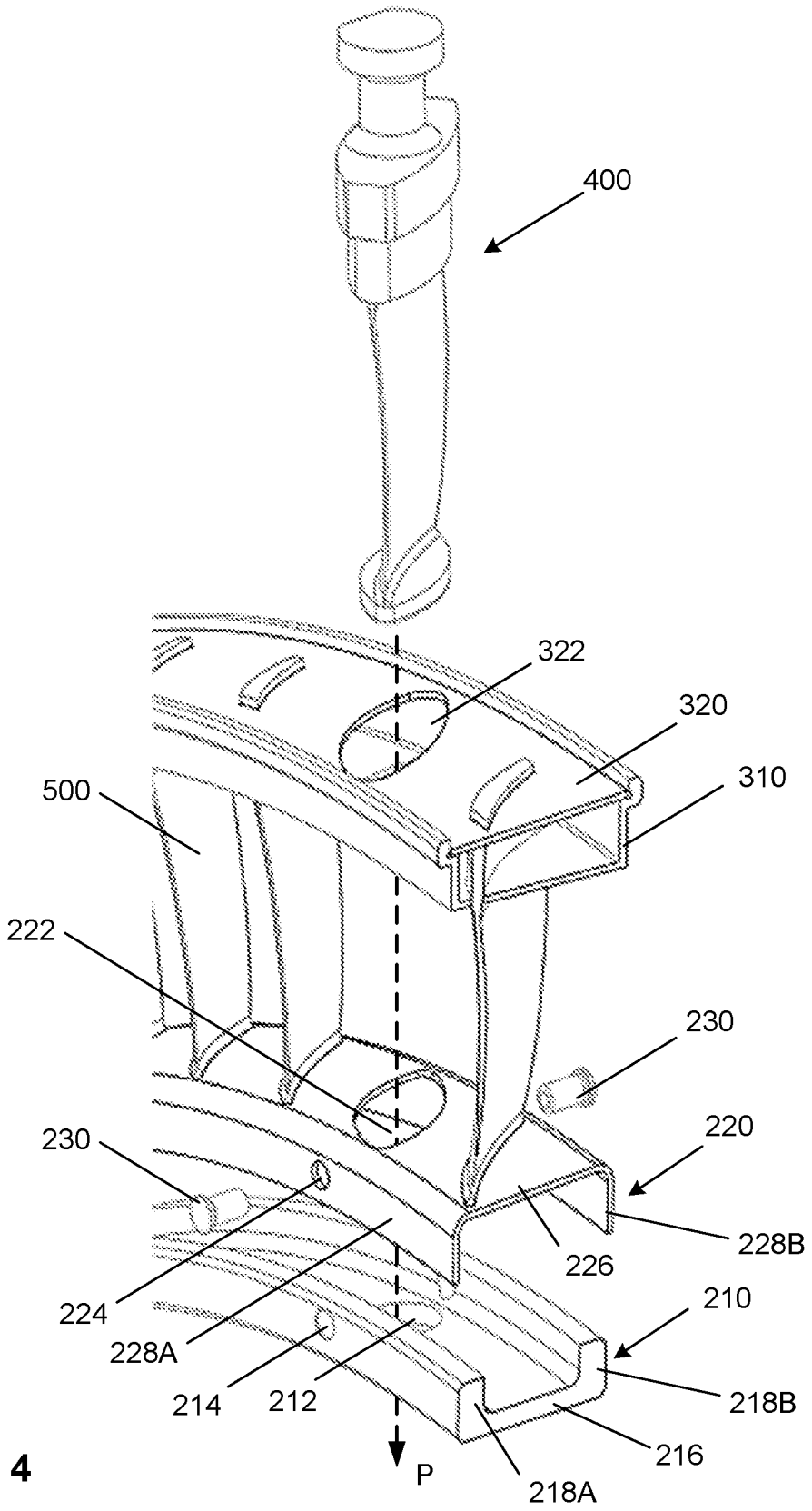
FIG. 4 illustrates an exploded cross-sectional view of a portion of a stator assembly for receiving a removable stator vane, according to an embodiment.

FIG. 4 illustrates an exploded cross-sectional view of a portion of stator assembly 100 that receives removable stator vane 400, according to an embodiment. Inner diameter ring assembly 200 comprises a seal ring 210 and a shroud ring 220. Outer diameter ring assembly 300 comprises an inner ring 310 and an outer ring 320.

In an embodiment, seal ring 210 comprises a seal ring aperture 212 through seal ring 210 along a radial axis R. Seal ring aperture 212 may be sized and shaped to allow an instrument for trim balancing or monitoring of gas path hardware health (e.g., balance weight hole fabrication tools, balance weight insertion and/or extraction tools, borescope, etc.) for trim balancing to pass through. Similarly, shroud ring 220 may comprise a shroud ring vane aperture 222 through shroud ring 220 along the same radial axis R as seal ring aperture 212. Shroud ring vane aperture 222 may be configured in size and shape to receive button 410 of removable stator vane 400. For example, the profile of shroud ring vane aperture 222 may correspond to the profile of button 410 to form an interference fit with button 410. The profile of shroud ring vane aperture 222 may also be configured in size and shape to entirely encompass the profile of seal ring aperture 212 therein, such that anything capable of passing through seal ring aperture 212 is also capable of passing through shroud ring vane aperture 222 when removable stator vane 400 is removed. However, the profile of seal ring aperture 212 may be sized and/or shaped to retard the passage of unseated balance weights from impacting shroud ring 220.

In the embodiment illustrated in FIG. 4, seal ring 210 and shroud ring 220 are both generally U-shaped in their cross section. For example, seal ring 210 may comprise a base 216 with a pair of side walls 218A and 218B extending radially outward from base 216 on opposite sides of base 216, and shroud ring 220 may comprise a base 226 with a pair of side walls 228A and 228B extending radially inward from base 226 on opposite sides of base 226. The inner width of shroud ring 220, in an axis parallel to longitudinal axis L, may be equal to or greater than the outer width of seal ring 210, in the axis parallel to longitudinal axis L. Thus, shroud ring 220 fits over seal ring 210 to shroud seal ring 210 therein. In addition, side walls 218A and 218B of seal ring 210 may comprise fastener holes 214, and side walls 228A and 228B of shroud ring 220 may comprise corresponding fastener holes 224 which are configured to align with fastener holes 214 when seal ring 210 is shrouded by shroud ring 220. Accordingly, fasteners 230 may be inserted through the aligned fastener holes 224 and 214, along an axis that is parallel to longitudinal axis L, to thereby mount shroud ring 220 to seal ring 210, so as to secure seal ring 210 within shroud ring 220. Furthermore, shroud ring 220 may comprise a plurality of apertures (not shown), along a radial axis R, that are sized and shaped to receive an end of each fixed stator vane 500 therethrough, to thereby fix the radially inner end of each fixed stator vane 500 within a cavity between shroud ring 220 and seal ring 210.

In an embodiment, inner ring 310 and outer ring 320 are configured to be fastened to each other to form outer diameter ring assembly 300. For example, inner ring 310 may be generally U-shaped, and outer ring 320 may be positioned (e.g., aligned with ring features, tack welded, brazed, etc.) in the interior sides of inner ring 310. Inner ring 310 may comprise an inner ring vane aperture 312 (visible in FIG. 12), and outer ring 320 may comprise an outer ring vane aperture 322. Inner ring vane aperture 312 and outer ring vane aperture 322 may be configured in size and shape to receive platform 430, airfoil 420, and button 410 therethrough. In addition, outer ring vane aperture 322 may be configured in size and shape to prevent passage of stop 440 therethrough. For example, the profile of outer ring vane aperture 322 may correspond to the profile of platform 430 to form an interference fit with platform 430. Inner ring vane aperture 312 may be configured in size and shape to prevent passage of platform 430 therethrough or may have an identical profile to outer ring vane aperture 322 (e.g., to form an interference fit with platform 430).

The profile of inner ring vane aperture 312 may be configured in size and shape to entirely encompass the profile of shroud ring vane aperture 222 (and therefore, seal ring aperture 212), such that anything capable of passing through shroud ring vane aperture 222 is also capable of passing through inner ring vane aperture 312. Similarly, the profile of outer ring vane aperture 322 may be configured in size and shape to entirely encompass the profile of inner ring vane aperture 312 (and therefore, shroud ring vane aperture 222 and seal ring aperture 212), such that anything capable of passing through inner ring vane aperture 312 is also capable of passing through outer ring vane aperture 322. As used herein, a profile that "encompasses" another profile may be any profile that is either identical to or larger than the other profile.

Removable stator vane 400 may be inserted along a radial axis R through outer ring vane aperture 322, inner ring vane aperture 312, and shroud ring vane aperture 222, such that button 410 is seated within shroud ring 220, and platform 430 is seated within outer ring 320 and inner ring 310. Removable stator vane 400 is prevented from moving radially inward beyond seal ring 210, at least because button 410 cannot pass through seal ring aperture 212 and/or stop 440 cannot pass through outer ring vane aperture 322. The profile of button 410 may be sized and shaped to match the profile of shroud ring aperture 222, such that, when removable stator vane 400 is seated within stator assembly 100, button 410 completely fills shroud ring aperture 222. Fluid passage from one side of seal ring 210 to the other side of seal ring 210 along the radial axis R is restricted by button 410 covering seal ring aperture 222.

Removable stator vane 400 may be removed from stator assembly 100 by being pulled outward along the radial axis R. For example, a technician may grip knob 460 of removable stator vane 400 and pull removable stator vane 400 completely out, such that button 410 passes through shroud ring vane aperture 222, inner ring vane aperture 312, and outer ring vane aperture 322, to thereby expose these apertures. Thus, when removable stator vane 400 has been removed from stator assembly 100, a radial pathway P exists through outer ring vane aperture 322, inner ring vane aperture 312, shroud ring vane aperture 222, and seal ring aperture 212 to the space interior to stator assembly 100. Thus, components of a larger assembly within that space may be accessed through stator assembly 100 via radial pathway P by removing removable stator vane 400.

One end of each of the plurality of fixed stator vanes 500 may protrude through respective vane apertures in shroud ring 220, and the opposite end of each of the plurality of fixed stator vanes 500 may protrude through respective vane apertures in inner ring 310 and outer ring 320 of outer diameter ring assembly 300. Thus, one end of each fixed stator vane 500 is seated within the cavity in inner diameter ring assembly 200, and the other end of each fixed stator vane 500 is seated within the cavity in outer diameter ring assembly 300. It should be understood that each vane aperture is sized and shaped to receive the respective end of each fixed stator vane 500 therethrough, and that each fixed stator vane 500 and its respective vane apertures may be identical to each other. In addition, the airfoil of each fixed stator vane 500 may be identical to airfoil 420 of removable stator vane 400. Fixed stator vanes 500 may differ from removable stator vane 400 in that they do not possess button 410, platform 430, stop 440, stem 450, and knob 460. Fixed stator vanes 500 may be fixed within stator assembly 100 for as long as stator assembly 100 is assembled. In other words, fixed stator vanes 500 may be removable, but only via disassembly of stator assembly 100. Thus, it should be understood that, as used herein, the term "fixed" in the phrase "fixed stator vane" means fixed in place for as long as stator assembly 100 is fully assembled, whereas the term "removable" in the phrase "removable stator vane" means removable even while stator assembly 100 remains fully assembled.

Figure 5:
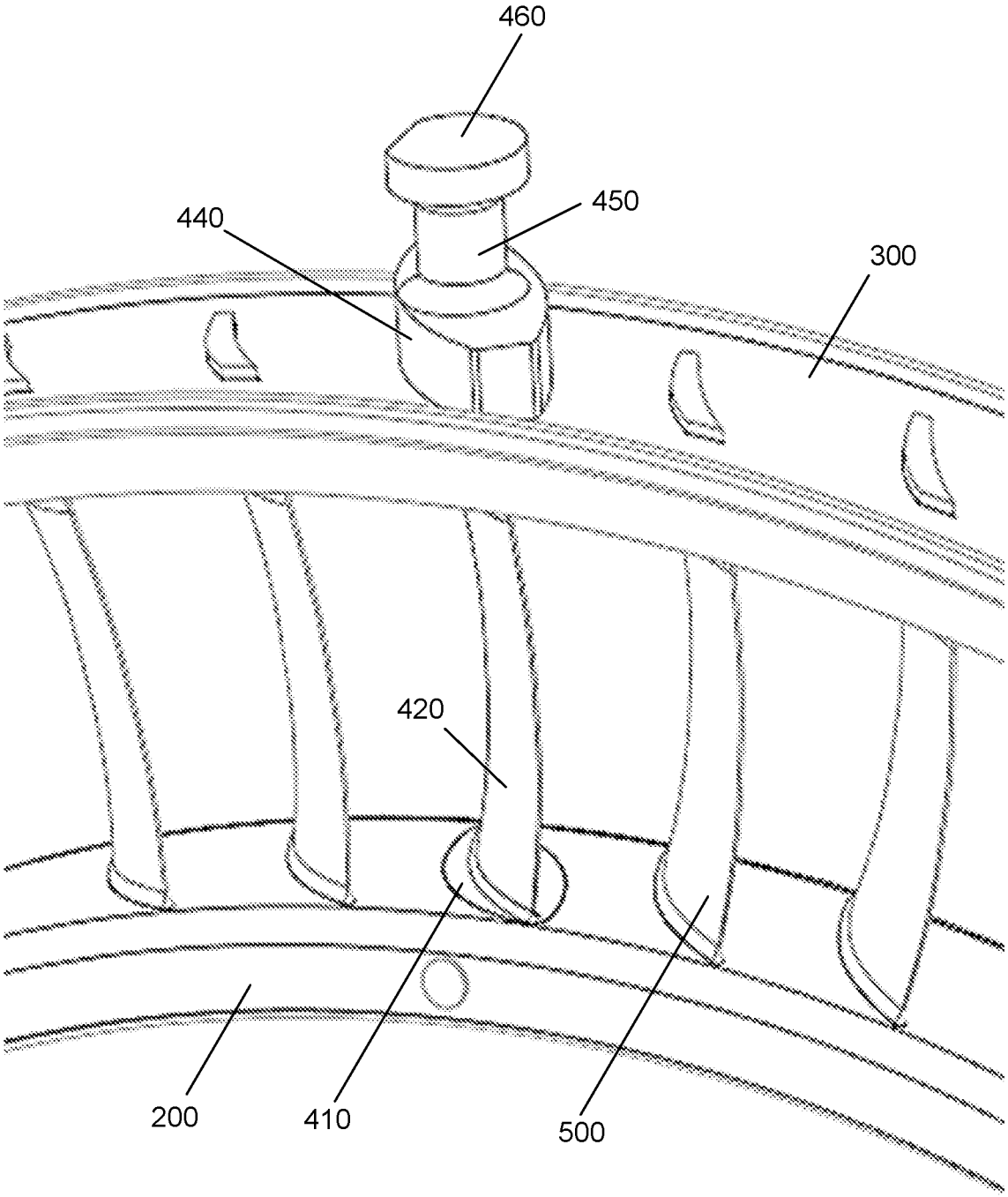
FIG. 5 illustrates a close-up perspective view of the portion of a stator assembly with an installed removable stator vane, according to an embodiment.

FIG. 5 illustrates a close-up perspective view of the portion of stator assembly 100 housing removable stator vane 400, according to an embodiment. As illustrated, when removable stator vane 400 is seated within stator assembly 100 (i.e., with airfoil 420 positioned between inner diameter ring assembly 200 and outer diameter ring assembly 300), button 410 of removable stator vane 400 is seated within shroud ring vane aperture 222. The profile of shroud ring vane aperture 222 may be sized and shaped to exactly match the outer profile of button 410 so as to form an interference fit with button 410, such that there is minimal or no fluid communication through shroud ring vane aperture 222 (e.g., into a cavity between shroud ring 220 and seal ring 210) while button 410 is seated within shroud ring vane aperture 222. In addition, when removable stator vane 400 is seated within stator assembly 100, platform 430 (not visible in FIG. 5) is seated in outer diameter ring assembly 300 within a cavity between inner ring 310 and outer ring 320, while stop 440 rests on the radially outer surface of outer ring 320 of outer diameter ring assembly 300. The installation of removable stator vane 400 along radial pathway P may be governed by stop 440, which sits on outer ring 320.

Figure 6:
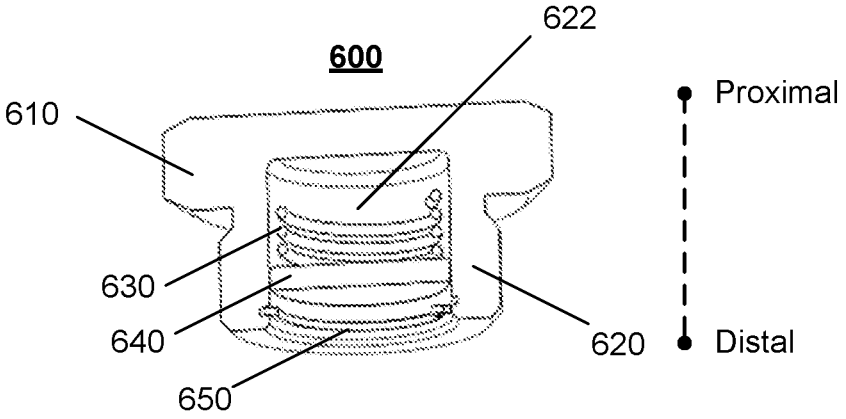
FIG. 6 illustrates a cross-sectional perspective view of an assembled case access assembly, according to an embodiment.
Figure 7:
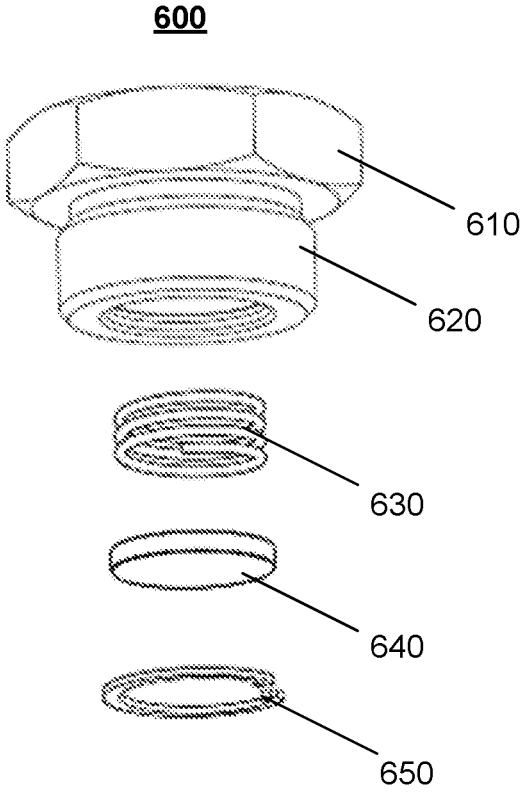
FIG. 7 illustrates an exploded perspective view of a case access assembly, according to an embodiment.

FIG. 6 illustrates a cross-sectional perspective view of an case access assembly 600, and FIG. 7 illustrates an exploded perspective view of case access assembly 600, according to an embodiment. As illustrated, case access assembly 600 has a proximal end and a distal end, and comprises a cap 610, neck 620, spring 630, strike plate 640, and retaining ring 650. Case access assembly 600 may be fitted over knob 460 of removable stator vane 400 to hold it in place, while removable stator vane 400 is seated in stator assembly 100. Accordingly, case access assembly 600 should be sized and shaped to receive knob 460 therein. For example, the inner diameter and profile of the open end of neck 620 should be configured to encompass the outer diameter and profile of knob 460.

The profile of cap 610 may be a hexagon or other polygon to aid in gripping for rotation (e.g., tightening and loosening of case access assembly 600) by a tool (e.g., wrench, fingers, etc.). Cap 610 may be integral with neck 620, for example, as a single unitary piece of material. Spring 630 is seated at a proximal end of an interior cavity 622 in the cap 610 and neck 620. Strike plate 640 is seated over spring 630, closer to the distal end of interior cavity 622 than spring 630. Strike plate 640 may have a diameter that is equal to or greater than the diameter of spring 630, such that it completely covers spring 630 from the distal end of neck 620. When a force that exceeds the force of spring 630 is applied to strike plate 640, spring 630 is compressed in a proximal direction. Retaining ring 650 may fit within a groove in the interior wall of neck 620 near the distal end of interior cavity 622 of neck 620. The inner diameter of retaining ring 650 is smaller than the inner diameter of the groove and smaller than the diameter of strike plate 640, such that retaining ring 650 protrudes out of the groove, to thereby prevent strike plate 640 from sliding out of interior cavity 622 of case access assembly 600.

In use, case access assembly 600 fits over knob 460 of removable stator vane 400. Thus, as case access assembly 600 is secured to a casing around stator assembly 100 (e.g., via rotation that engages corresponding threads to thereby mate case access assembly 600 to the casing), the top of knob 460 pushes against strike plate 640, thereby compressing spring 630. In turn, the force of compressed spring 630 is transferred through strike plate 640 to knob 460 of removable stator vane 400, thereby sealing removable stator vane 400 in place within stator assembly 100 to prevent removable stator vane 400 from moving in the radial direction.

INDUSTRIAL APPLICABILITY

Figure 8:
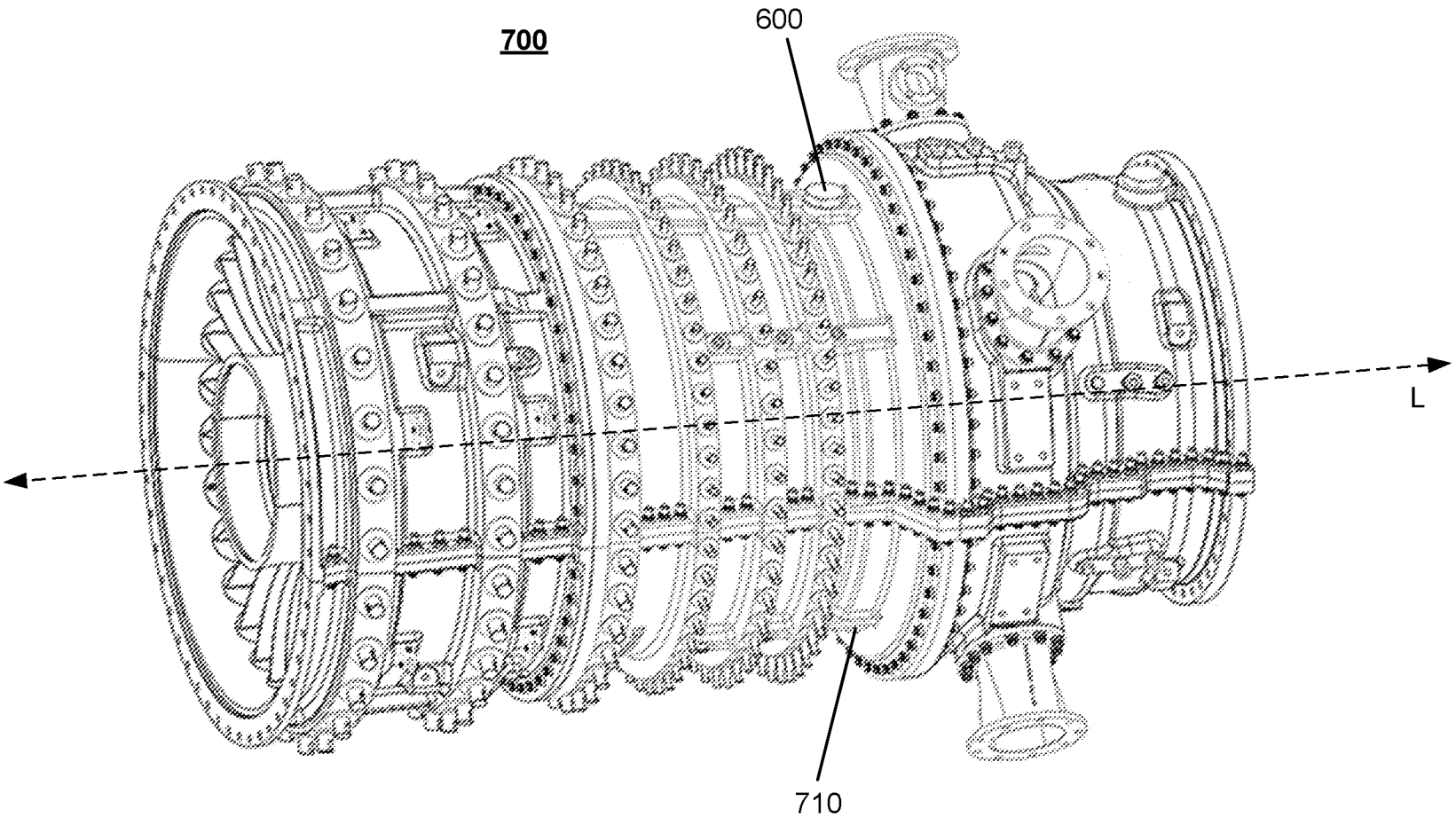
FIG. 8 illustrates a perspective view of a compressor case assembly, according to an embodiment.
Figure 9:
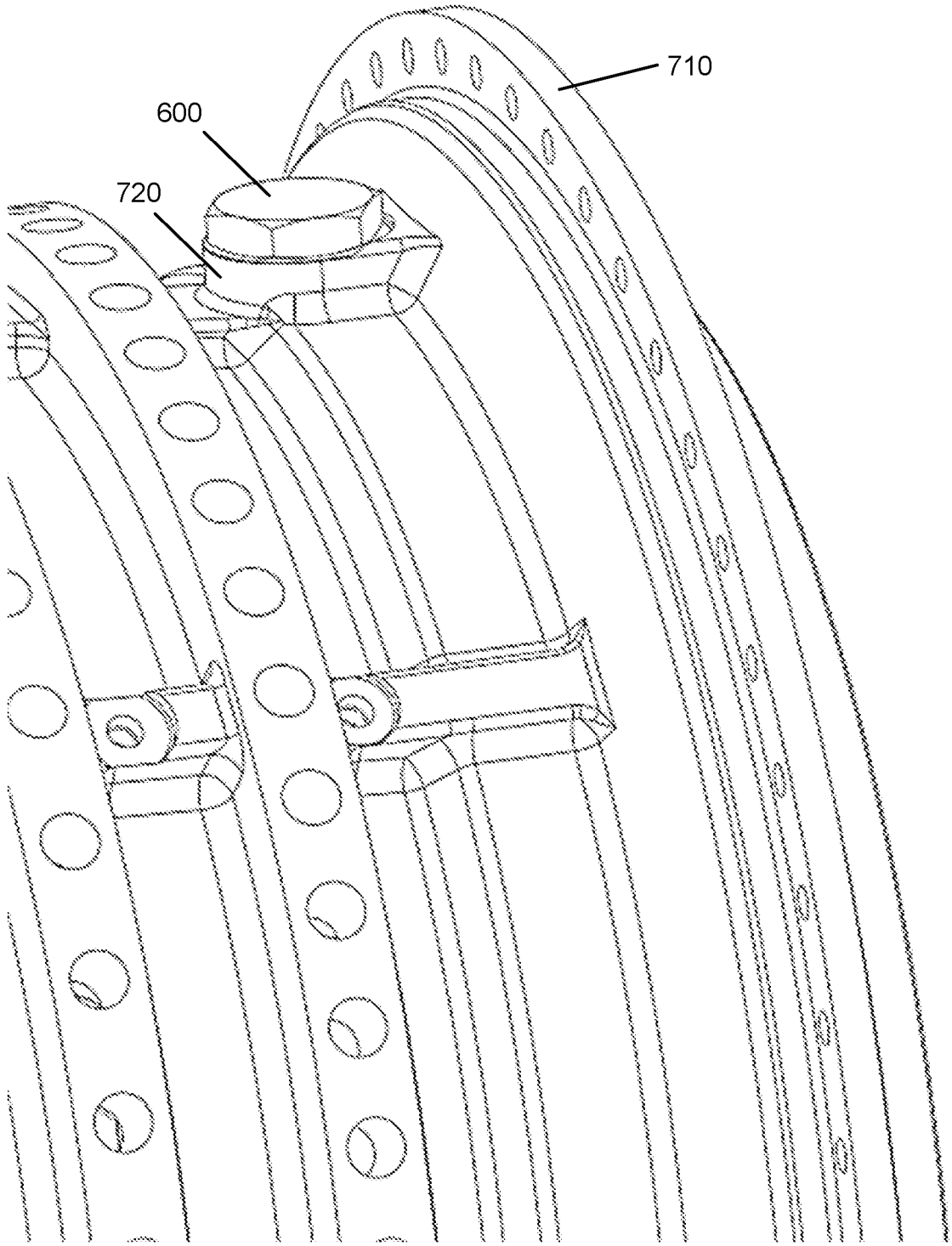
FIG. 9 illustrates a close-up perspective view of a portion of a compressor case assembly housing a stator assembly and a compressor rotor assembly, according to an embodiment.

FIG. 8 illustrates a perspective view of a compressor case assembly 700, and FIG. 9 illustrates a close-up perspective view of a portion of compressor case assembly 700 housing a stator assembly 100, according to an embodiment. As illustrated, compressor case assembly 700 comprises a middle compressor case 710, which is illustrated in perspective view in FIG. 9. Case access assembly 600 engages with a case boss 720 that defines a case aperture (e.g., case aperture 722 illustrated in FIG. 11) along a radial axis R through middle compressor case 710, thereby sealing the case aperture from the external environment of middle compressor case 710. Case access assembly 600 may engage with case boss 720 through any releasable engagement means. For example, threads around the exterior of neck 620 may engage with threads around the interior of the case aperture (e.g., case aperture 722) of case boss 720.

Figure 10:
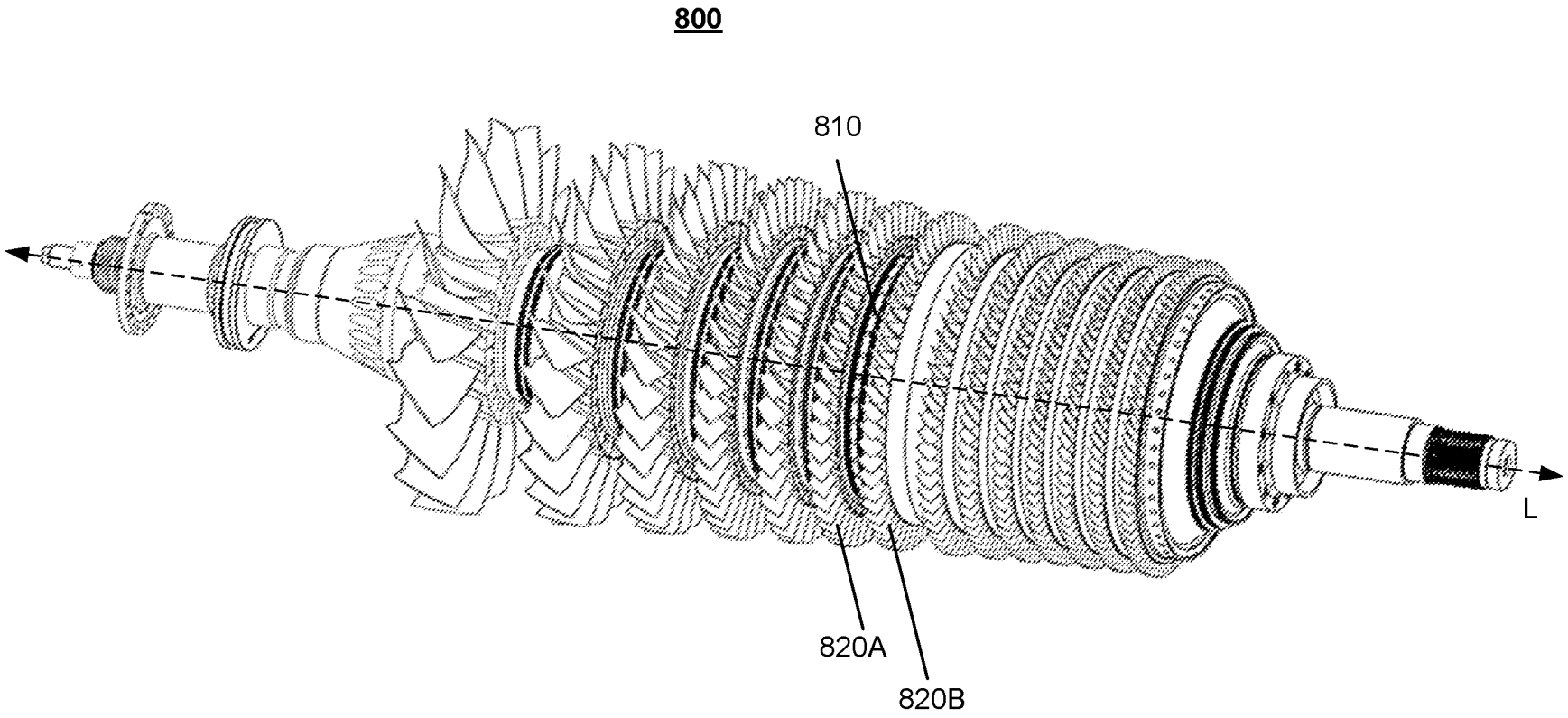
FIG. 10 illustrates a perspective view of a compressor rotor assembly, according to an embodiment.

FIG. 10 illustrates a perspective view of a compressor rotor assembly 800, according to an embodiment. As illustrated, a mid-plane trim balance rotor disc 810 is situated near a middle portion of compressor rotor assembly 800 between two rotating blade rows 820 (e.g., illustrated as a forward rotating blade row 820A and an aft rotating blade row 820B). In an embodiment, stator assembly 100 is mounted around mid-plane trim balance rotor disc 810, and provides access to mid-plane trim balance rotor disc 810 via radial pathway P (see FIG. 4).

Figure 11:
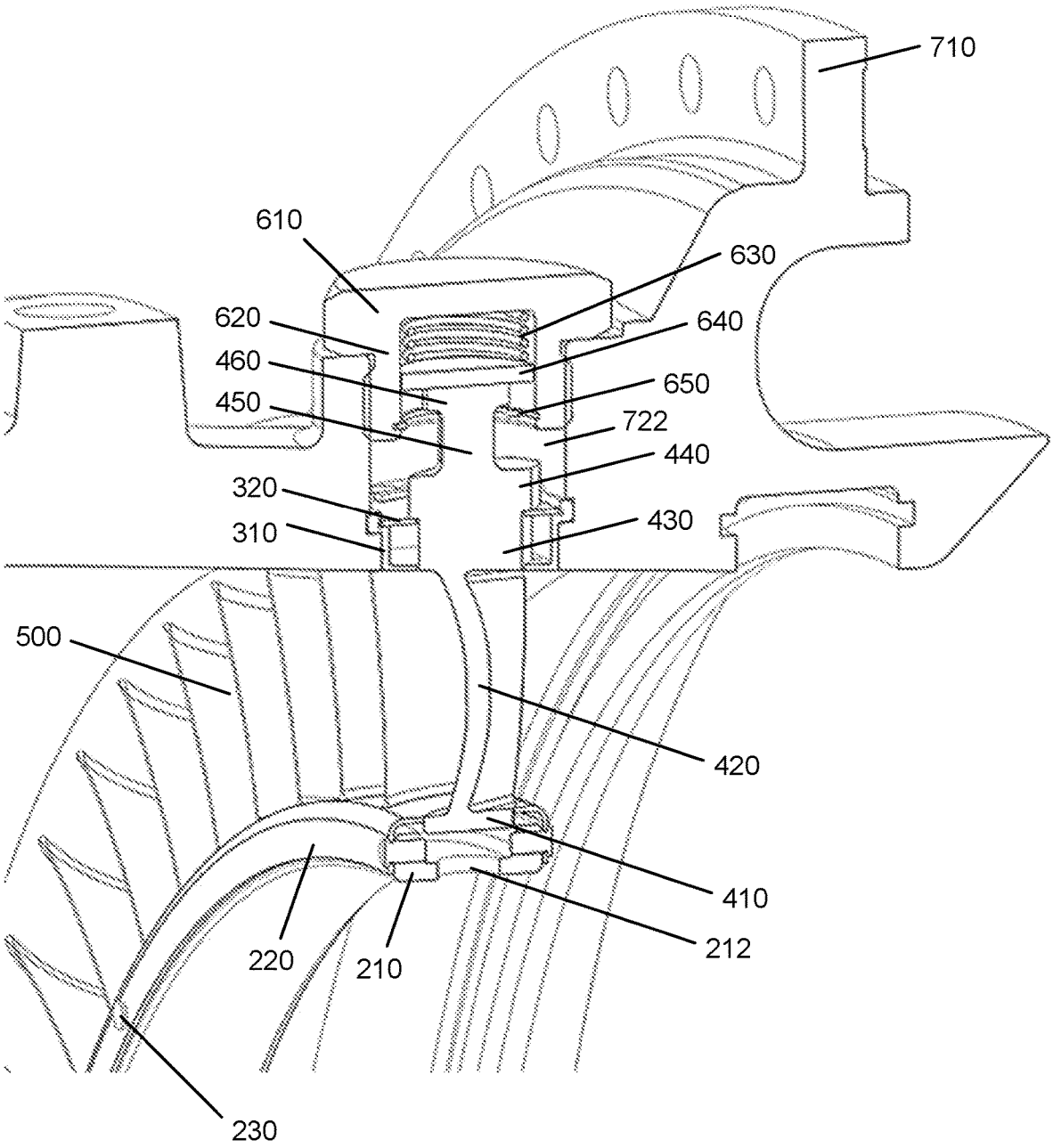
FIG. 11 illustrates a cross-sectional perspective view of a portion of a compressor case assembly with a removable stator vane seated in a stator assembly, according to an embodiment.
Figure 12:
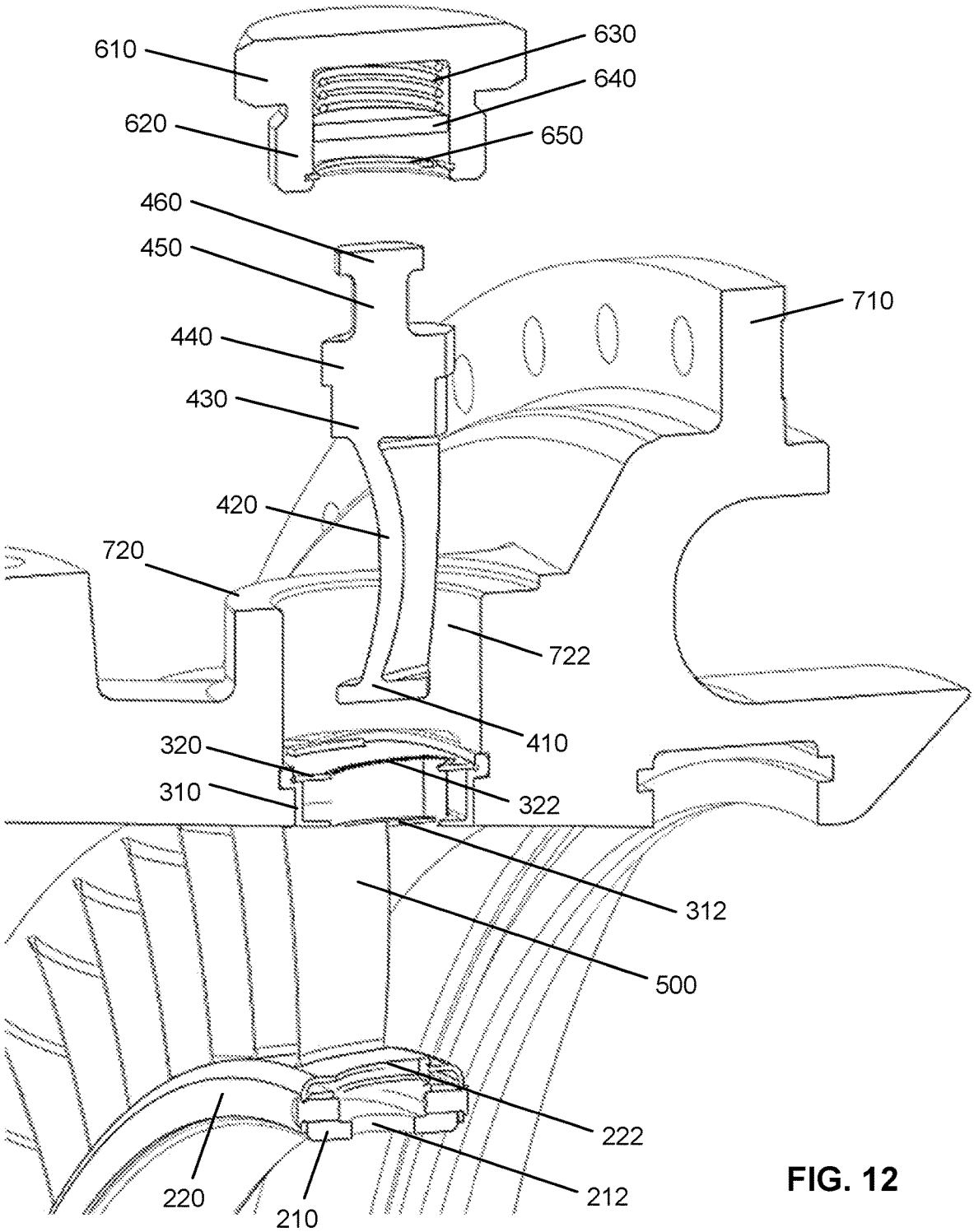
FIG. 12 illustrates a cross-sectional exploded perspective view of a portion of a compressor case assembly with a case access assembly removed from a portion of a compressor case assembly and a removable stator vane removed from the stator assembly, according to an embodiment.

FIGS. 11 and 12 both illustrate a cross-sectional perspective view of a portion of middle compressor case 710 housing stator assembly 100, according to an embodiment. In FIG. 11, removable stator vane 400 is seated within stator assembly 100, and case access assembly 600 is engaged with case boss 720 of middle compressor case 710. In FIG. 12, removable stator vane 400 has been removed from stator assembly 100, and case access assembly 600 has been disengaged from case boss 720 of middle compressor case 710.

As illustrated in FIG. 11, neck 620 of case access assembly 600 can be releasably secured within a case aperture 722 of case boss 720. Spring 630 applies a force, through strike plate 640, to knob 460 of removable stator vane 400, to prevent radial movement of removable stator vane 400. In other words, when installed, removable stator vane 400 is prevented from moving radially outward from outer ring 320 by the load established by the installed case access assembly 600. Accordingly, button 410 remains seated within shroud ring vane aperture 222, thereby covering seal ring aperture 212 and preventing fluid that is traveling across airfoil 420 from leaking through seal ring aperture 212 to mid-plane trim balance rotor disc 810. Similarly, platform 430 remains seated within outer diameter ring assembly 300, including inner ring vane aperture 312 and outer ring vane aperture 322. Notably, stop 440 may prevent removable stator vane 400 from being pushed too far radially inward into radial pathway P.

As illustrated in FIG. 12, when case access assembly 600 is disengaged from case boss 720, removable stator vane 400 may be removed from stator assembly 100 along a radial axis R (see FIG. 1). Removal of case access assembly 600 and removable stator vane 400 opens up a pathway P (see FIG. 4), along radial axis R, through case aperture 722, outer ring vane aperture 322, inner ring vane aperture 312, shroud ring vane aperture 222, and seal ring aperture 212. When stator assembly 100 is mounted around mid-plane trim balance rotor disc 810, this pathway P enables a technician to access mid-plane trim balance rotor disc 810 using one or more instruments, for example, to perform trim balancing. In other words, a line of sight is provided through shroud ring vane aperture 222 and seal ring aperture 212 to mid-plane trim balance rotor disc 810. Thus, the technician is able to access mid-plane trim balance rotor disc 810 without having to disassemble compressor case assembly 700.

Figure 13:
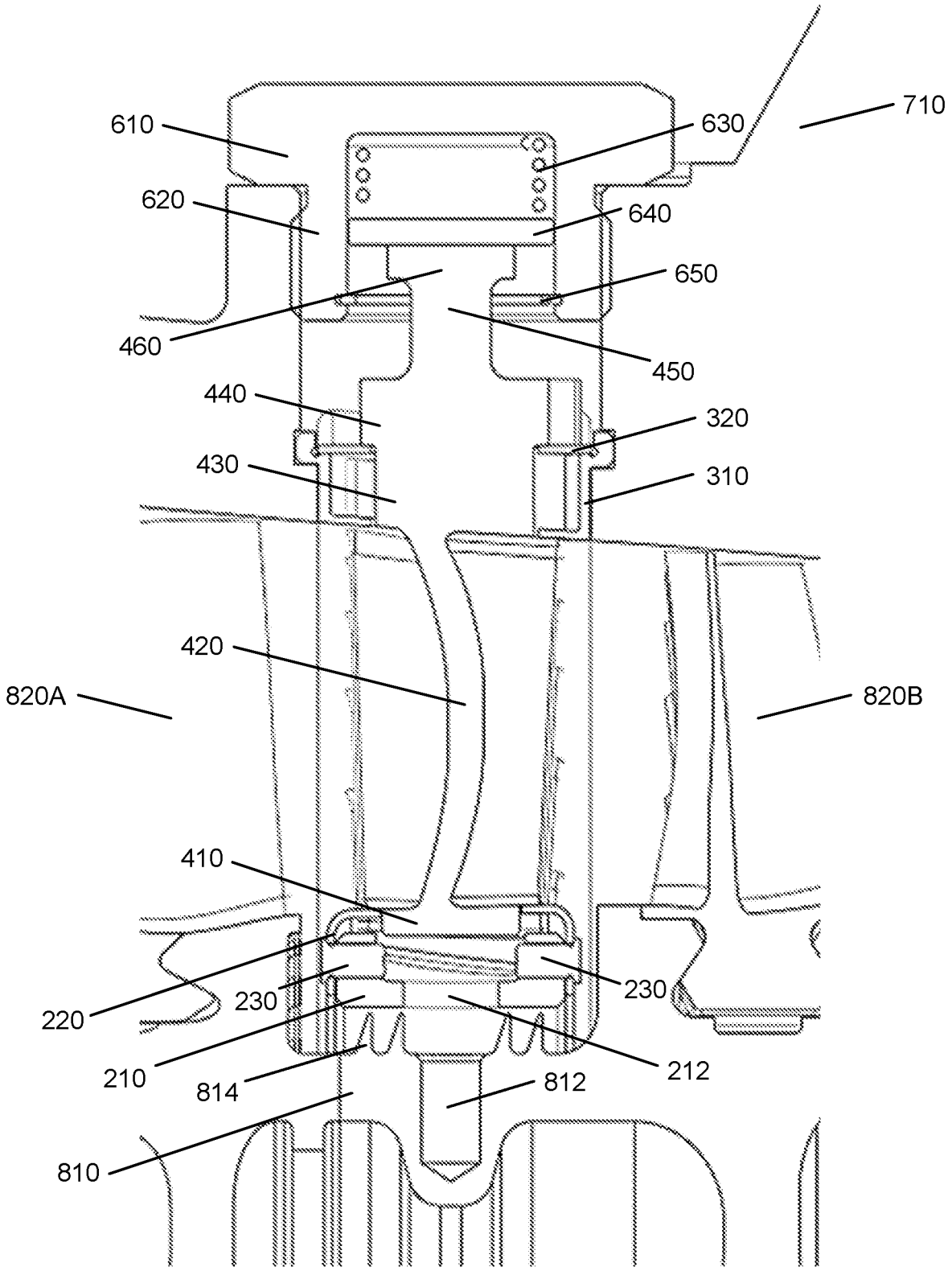
FIG. 13 illustrates a cross-sectional view of a portion of a compressor case assembly comprising an installed case access assembly and a stator assembly with a removable state vane installed, according to an embodiment.

FIG. 13 illustrates a cross-sectional view of a portion of a compressor comprising stator assembly 100, according to an embodiment. As illustrated, seal ring aperture 212 provides access to mid-plane trim balance rotor disc 810. This access enables one or more trim balance weight holes 812 to be created (e.g., drilled), along radial axis R, through the circumference of mid-plane trim balance rotor disc 810. Trim balance weight hole 812 may be threaded to mate with corresponding threads on a trim balance solution (e.g., weight). It should be understood that, generally, when mid-plane trim balance rotor disc 810 is first installed, it will not include a trim balance weight hole 812. One or more trim balance weight hole 812 can be created, via radial pathway P, following installation and without disassembling compressor case assembly 700, to enable the installation of in situ trim balance solutions. In other words, radial pathway P provides line-of-sight access to mid-plane trim balance rotor disc 810 that enables the application of rotor assembly trim solutions to bring compressor rotor assembly 800 back into balance, for example, after a gas turbine rotor assembly has been balanced during installation and the gas turbine has been initially operated.

In an embodiment, labyrinth seals 814 prevent fluid communication between an exterior environment of stator assembly 100 and trim balance weight hole 812. In other words, labyrinth seals 814 prevent fluid passage from one side of seal ring 210 to the other side of seal ring 210 along longitudinal axis L of stator assembly 100.

In an embodiment, stator assembly 100, in combination with case access assembly 600, is utilized in a compressor. In a state of operation of the compressor, removable stator vane 400 is held in place in stator assembly 100 by case access assembly 600 (e.g., preventing or reducing at least radially outward movement), the interaction of stop 440 with outer ring 320 (e.g., preventing or reducing at least radially inward movement), the interaction of platform 430 with outer ring aperture 322 and inner ring aperture 312 (e.g., preventing or reducing at least longitudinal movement), and the interaction of button 410 with shroud ring aperture 222 (e.g., preventing or reducing at least longitudinal movement). Case aperture 722, outer ring vane aperture 322, inner ring vane aperture 312, shroud ring vane aperture 222, and seal ring aperture 212 are sealed by these interactions to prevent fluid communication therethrough.

During trim balancing of the compressor, case access assembly 600 may be removed to expose removable stator vane 400. Then, removable stator vane 400 may be pulled radially outward from stator assembly 100 to expose mid-plane trim balance rotor disc 810 via radial pathway P through case aperture 722, outer ring vane aperture 322, inner ring vane aperture 312, shroud ring vane aperture 222, and seal ring aperture 212.

Accordingly, a technician may create one or a plurality of trim balance weight holes 812 around the circumference of mid-plane trim balance rotor disc 810 to facilitate trim balancing of compressor rotor assembly 800. Compressor rotor assembly 800 may be rotated or "clocked" while stator assembly 100 remains stationary to align a plurality of positions, around the circumference of mid-plane trim balance rotor disc 810, with radial axis R. Via the line-of-sight access provided by radial pathway P, a trim balance weight hole 812 may be created at each of these positions around the circumference of mid-plane trim balance rotor disc and a trim balance weight may be inserted into each trim balance weight hole 812 that is created. Each trim balance weight hole 812 may be threaded to engage with corresponding threads on the respective trim balance weight. The number of trim balance weight holes 812 may be determined according to any relevant trim balancing objectives or requirements.

Notably, the space between inner diameter ring assembly 200 and outer diameter ring assembly 300, which includes the airfoils of removable stator vane 400 and fixed stator vanes 500, is protected from intrusion by foreign objects, such as unseated balance weights from mid-plane trim balance rotor disc 810. For instance, an unseated balance weight that does not enter seal ring aperture 212 will be trapped between seal ring 210 and mid-plane trim balance rotor disc 810. An unseated balance weight that does enter seal ring aperture 212 will be trapped between seal ring 210 and shroud ring 220. Such an object will be prevented from passing through shroud ring aperture 222 by the presence of button 410 of removable stator vane 400 within shroud ring aperture 222. In other words, inner diameter ring assembly 200 provides access to mid-plane trim balance rotor disc 810 while also providing gas path flow sealing and protection against foreign object damage (FOD).

It should be understood that the materials used for the various components of the various embodiments described herein may be chosen according to the particular application for which the components or embodiments are to be used. A person of ordinary skill in the art will understand how to select these materials. As an illustrative, non-limiting example, the components may be made of various forms of steel. For instance, seal ring 210, shroud ring 220, outer diameter ring assembly 300, removable stator vane 400, fixed stator vanes 500, mid-plane trim balance rotor disc 810, and/or labyrinth seal 814 may be made of Grade-410 Stainless Steel. Fasteners 230 may be made of alloy steel. Cap 610 may be made of Grade-316 Stainless Steel, and spring 630, strike plate 640, and retaining ring 650 may be made of Grade-302 Stainless Steel. Middle compressor case 710 may be made of CA6NM Stainless Steel, and rotating blade rows 820 may be made of 17-4 Stainless Steel.

Disclosed embodiments enable a gas turbine engine to be balanced in situ with the compressor case. Access to rotating components through radial pathway P, from the exterior of the compressor case, can be very efficient with lower cost. Trim balancing can be accomplished by adding and/or removing weights to mid-plane trim balance rotor disc 810, to reduce undesired vibration, thereby increasing the reliability and service life of engine components (e.g., blades, bearings, seals, etc.).

It will be understood that the benefits and advantages described above may relate to one embodiment or may relate to several embodiments. Aspects described in connection with one embodiment are intended to be able to be used with the other embodiments. Any explanation in connection with one embodiment applies to similar features of the other embodiments, and elements of multiple embodiments can be combined to form other embodiments. The embodiments are not limited to those that solve any or all of the stated problems or those that have any or all of the stated benefits and advantages.

The preceding detailed description is merely exemplary in nature and is not intended to limit the invention or the application and uses of the invention. The described embodiments are not limited to usage in conjunction with a particular type of rotor assembly. Hence, although the present embodiments are, for convenience of explanation, depicted and described as being implemented in a compressor, it will be appreciated that it can be implemented in various other types of machines, and in various other systems and environments. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. A stator assembly for use in a gas turbine engine having a mid-plane trim balance rotor disc, the stator assembly comprising:

a seal ring comprising a seal ring aperture extending therethrough along a radial axis, wherein the seal ring is configured to mount around the mid-plane trim balance rotor disc, wherein the seal ring aperture is configured to, when the seal ring is mounted around the mid-plane trim balance rotor disc, provide access to the mid-plane trim balance rotor disc along the radial axis;

a shroud ring mounted around the seal ring to form an inner diameter ring assembly, wherein the shroud ring comprises a shroud ring vane aperture that is aligned with the seal ring aperture along the radial axis;

an outer diameter ring assembly that is concentric with the inner diameter ring assembly and has a larger diameter than the inner diameter ring assembly, wherein the outer diameter ring assembly comprises a vane aperture that is aligned with the shroud ring vane aperture and the seal ring aperture along the radial axis;

a plurality of fixed stator vanes that each comprise an airfoil that extends between the inner diameter ring assembly and the outer diameter ring assembly; and a removable stator vane configured to be seated within the shroud ring vane aperture in the shroud ring and the vane aperture in the outer diameter ring assembly, so that an airfoil of the removable stator vane extends between the inner diameter ring assembly and the outer diameter ring assembly along the radial axis, wherein the removable stator vane is configured to be removed by being pulled radially outward along the radial axis.

2. The stator assembly of claim 1, wherein a profile of the shroud ring vane aperture encompasses a profile of the seal ring aperture.

3. The stator assembly of claim 2, wherein the profile of the shroud ring vane aperture is larger than the profile of the seal ring aperture.

4. The stator assembly of claim 3, wherein a profile of the vane aperture in the outer diameter ring assembly encompasses a profile of the shroud ring vane aperture.

5. The stator assembly of claim 3, wherein the outer diameter ring assembly comprises an inner ring and an outer ring, wherein the inner ring comprises an inner ring vane aperture that is aligned with the shroud ring vane aperture and the seal ring aperture along the radial axis, and wherein the outer ring comprises an outer ring vane aperture that is aligned with the inner ring vane aperture, the shroud ring vane aperture, and the seal ring aperture, along the radial axis.

6. The stator assembly of claim 5, wherein a profile of the inner ring vane aperture encompasses a profile of the shroud ring vane aperture, and wherein a profile of the outer ring vane aperture encompasses a profile of the inner ring vane aperture.

7. The stator assembly of claim 3, wherein the removable stator vane comprises:

a button that is configured to be seated within the shroud ring vane aperture and prevent fluid communication through shroud ring vane aperture; and a platform that is configured to be seated within the vane aperture in the outer diameter ring assembly when the button is seated within the shroud ring vane aperture.

8. The stator assembly of claim 7, wherein the removable stator vane further comprises a stop that is positioned radially outward from the platform and has a larger profile than the vane aperture of the outer diameter ring assembly, so as to prevent any portion of the removable stator vane that is radially outward from the platform from being inserted through the vane aperture in the outer diameter ring assembly.

9. The stator assembly of claim 8, wherein the removable stator vane further comprises a stem that is positioned radially outward from the stop.

10. The stator assembly of claim 9, wherein the removable stator vane further comprises a knob that is positioned radially outward from the stem.

11. The stator assembly of claim 10, further comprising a case access assembly that is configured to fit around the knob of the removable stator vane.

12. The stator assembly of claim 11, wherein the case access assembly comprises a spring in an interior cavity of the case access assembly, wherein the interior cavity of the case access assembly is configured to receive the knob of the removable stator vane therein, and wherein the spring is configured to impart a radially inward force on the knob of the removable stator vane when the knob of the removable stator vane is received within the interior cavity of the case access assembly while the case access assembly is installed.

13. The stator assembly of claim 12, wherein the case access assembly further comprises a strike plate between the spring and an open end of the interior cavity of the case access assembly.

14. The stator assembly of claim 13, wherein the case access assembly further comprises a retaining ring between the strike plate and the open end of the interior cavity of the case access assembly, wherein the retaining ring is configured to retain the strike plate within the interior cavity of the case access assembly.

15. A compressor comprising:

the mid-plane trim balance rotor disc;

such stator assembly of claim 13 mounted around the mid-plane trim balance rotor disc, such that the seal ring aperture, the shroud ring vane aperture, and the vane aperture in the outer diameter ring assembly are all aligned along the radial axis; and a compressor case assembly that comprises a case aperture that is aligned with the seal ring aperture, the shroud ring vane aperture, and the vane aperture in the outer diameter ring assembly along the radial axis, wherein the case access assembly is configured to engage with the compressor case assembly to prevent access from an external environment of the compressor case assembly to the case aperture, and disengage from the compressor case assembly to provide access from the external environment to the case aperture.

16. The compressor of claim 15, wherein the compressor case assembly comprises a case boss with which the case access assembly is configured to engage and from which the case access assembly is configured to disengage.

17. A stator assembly comprising:

an inner diameter ring assembly that comprises a first vane aperture and a seal ring aperture aligned along a radial axis;

an outer diameter ring assembly that is concentric with the inner diameter ring assembly and has a larger diameter than the inner diameter ring assembly, wherein the outer diameter ring assembly comprises a second vane aperture that is aligned with the seal ring aperture and the first vane aperture along the radial axis;

a plurality of fixed stator vanes that each comprise an airfoil extending between the inner diameter ring assembly and the outer diameter ring assembly; and a removable stator vane comprising a button configured to be seated within the first vane aperture, a platform configured to be seated within the second vane aperture, and an airfoil between the button and the platform, wherein, while the button is seated within the first vane aperture and the platform is seated within the second vane aperture, the airfoil extends between the inner diameter ring assembly and the outer diameter ring assembly along the radial axis, and wherein the removable stator vane is configured to be removed by being pulled radially outward along the radial axis.

18. The stator assembly of claim 17, further comprising a case access assembly that is configured to fix a position of the removable stator vane along the radial axis.

* * * * *